US007559532B1

(12) United States Patent
Kodi

(10) Patent No.: US 7,559,532 B1
(45) Date of Patent: Jul. 14, 2009

(54) HAND APPLICATOR FOR REINFORCEMENT BAR CLIPS

(76) Inventor: Jon R. Kodi, 509 W. Spring St., Lebanon, TN (US) 37087

( * ) Notice: Subject to any disclaimer, the term of this patent is extended or adjusted under 35 U.S.C. 154(b) by 154 days.

(21) Appl. No.: 11/333,756

(22) Filed: Jan. 17, 2006

Related U.S. Application Data

(63) Continuation of application No. 11/122,195, filed on May 3, 2005, and a continuation of application No. 11/142,539, filed on Jun. 1, 2005.

(51) Int. Cl.
*B66F 15/00* (2006.01)

(52) U.S. Cl. ..... 254/21; 52/749.1; 52/DIG. 1; 81/3.55

(58) Field of Classification Search ..... 52/686, 52/677, 684, 719, 749.1, DIG. 1; 254/25; 245/21, 24, 25; 81/3.55, 3.57
See application file for complete search history.

(56) References Cited

U.S. PATENT DOCUMENTS

| | | | | | |
|---|---|---|---|---|---|
| 1,164,776 | A | * | 12/1915 | Arbanasin | 30/408 |
| 1,852,673 | A | | 4/1932 | Pilj | |
| 1,986,528 | A | | 1/1935 | Ranger | 72/122 |
| 2,551,826 | A | | 5/1951 | Cox, Sr. | 72/122 |
| 2,571,337 | A | | 10/1951 | Burnham | 61/48 |
| 2,879,087 | A | | 3/1959 | Haglund | 287/54 |
| 2,964,763 | A | * | 12/1960 | Nagy et al. | 7/152 |
| 3,006,115 | A | | 10/1961 | Hillberg | 50/322 |
| 3,216,752 | A | | 11/1965 | Rifken | 287/54 |
| 3,360,883 | A | | 1/1968 | Glanzer | 46/29 |
| 3,522,932 | A | * | 8/1970 | Nakasone | 254/131 |
| 3,788,025 | A | | 1/1974 | Holmes | 52/685 |
| 4,060,954 | A | | 12/1977 | Liuzza | 52/677 |
| 4,080,770 | A | | 3/1978 | Vigh | 52/689 |
| 4,110,951 | A | * | 9/1978 | Padrun | 52/686 |
| 4,136,984 | A | | 1/1979 | Hayashi | 403/170 |
| 4,136,985 | A | | 1/1979 | Taul | 403/172 |
| 4,214,841 | A | | 7/1980 | Hayashi | 403/188 |
| 4,440,519 | A | | 4/1984 | Pennel et al. | 403/391 |
| 4,482,088 | A | | 11/1984 | Hyun | 227/67 |
| 4,511,073 | A | | 4/1985 | Furutsu | 227/67 |

(Continued)

FOREIGN PATENT DOCUMENTS

| | | |
|---|---|---|
| JP | 04108944 | 4/1992 |

*Primary Examiner*—Richard E Chilcot, Jr.
*Assistant Examiner*—Anthony N Bartosik
(74) *Attorney, Agent, or Firm*—Waddey & Patterson, P.C.; Lucian Wayne Beavers

(57) ABSTRACT

A hand applicator of a system for installing clips upon reinforcement bars includes a receiver tip extending from a palm plate and having a width selected to receive clips made of opposing clasp assemblies adapted to allow the user to attach the first clasp assembly of the bar clip to a reinforcement bar without direct manipulation of the bar clip onto the bar. The applicator further includes a retaining plate having a guide channel adapted to receive an extended thumb or finger from the user's hand while gripping the palm plate. The hand applicator includes a heel plate attached or integrally affixed to the palm plate and disposed so as to define a heel angle of between about 90 degrees and about 180 degrees. The heel plate is operable with the palm plate and the retaining plate to provide for ease of gripping and controlling the hand applicator with one hand of the user.

8 Claims, 4 Drawing Sheets

U.S. PATENT DOCUMENTS

| | | | | | |
|---|---|---|---|---|---|
| 4,610,122 | A | | 9/1986 | De Clercq | 52/719 |
| 4,617,775 | A | | 10/1986 | Padrun | 52/684 |
| 4,631,769 | A | * | 12/1986 | White | 7/151 |
| 4,800,702 | A | | 1/1989 | Wheeler | 52/677 |
| 4,835,933 | A | | 6/1989 | Yung | 52/685 |
| 4,901,411 | A | * | 2/1990 | Chestnut et al. | 42/108 |
| 4,991,372 | A | | 2/1991 | Sonneville | 52/685 |
| 5,370,293 | A | | 12/1994 | Bevins | 227/63 |
| 5,371,991 | A | | 12/1994 | Bechtel et al. | 52/686 |
| D355,582 | S | | 2/1995 | Sleight | D8/354 |
| 5,518,399 | A | | 5/1996 | Sicurelli, Jr. et al. | 433/220 |
| 5,588,554 | A | | 12/1996 | Jones | 221/88 |
| 5,595,039 | A | | 1/1997 | Lowery | 52/677 |
| 5,626,436 | A | * | 5/1997 | Dragone | 403/400 |
| 5,683,025 | A | | 11/1997 | Grendol | 227/67 |
| 5,695,172 | A | * | 12/1997 | Hreha | 254/25 |
| 5,697,591 | A | | 12/1997 | Cooper | 248/229.16 |
| 5,752,297 | A | | 5/1998 | Ramey | 24/462 |
| 5,826,629 | A | | 10/1998 | West | 140/119 |
| 5,881,452 | A | * | 3/1999 | Nowell et al. | 29/816 |
| 5,893,252 | A | | 4/1999 | Hardy et al. | 52/685 |
| 6,148,488 | A | | 11/2000 | Gristock | 24/462 |
| 6,220,118 | B1 | * | 4/2001 | Pacheco et al. | 81/3.55 |
| 6,276,108 | B1 | | 8/2001 | Padrun | 52/684 |
| 6,354,054 | B1 | | 3/2002 | Verelli et al. | 52/686 |
| 6,371,763 | B1 | | 4/2002 | Sicurelli, Jr. et al. | 433/220 |
| 6,513,555 | B1 | | 2/2003 | Lesser et al. | 140/123.6 |
| 6,585,142 | B1 | | 7/2003 | Chen | 227/130 |
| 6,672,498 | B2 | | 1/2004 | White et al. | 227/120 |
| 6,725,535 | B2 | * | 4/2004 | Edson et al. | 29/809 |
| 6,857,246 | B2 | | 2/2005 | Erbetta et al. | 52/653.2 |
| 6,915,624 | B2 | | 7/2005 | Shibazaki et al. | 53/588 |
| 6,925,698 | B2 | | 8/2005 | Goodsmith et al. | 29/432.1 |
| 6,971,515 | B2 | | 12/2005 | Cooper et al. | 206/343 |
| 7,003,860 | B2 | | 2/2006 | Bloch et al. | 29/407.1 |
| D529,794 | S | | 10/2006 | Murray | D8/396 |
| 7,147,209 | B2 | * | 12/2006 | Jones et al. | 254/25 |
| D534,418 | S | | 1/2007 | Minor et al. | D8/396 |
| D540,631 | S | * | 4/2007 | Bryant | D8/14 |
| 2003/0154579 | A1 | | 8/2003 | Disher | 24/462 |
| 2004/0040247 | A1 | | 3/2004 | Morse | 52/649.8 |
| 2004/0154261 | A1 | | 8/2004 | Miller | 52/719 |
| 2004/0261352 | A1 | | 12/2004 | Bennett et al. | 52/698 |
| 2005/0217198 | A1 | | 10/2005 | Carraher et al. | 52/719 |

* cited by examiner

HAND APPLICATOR FOR REINFORCEMENT BAR CLIPS

CROSS-REFERENCES TO RELATED APPLICATIONS

This application is a Continuation application which claims benefit of co-pending U.S. patent application Ser. No. 11/122,195 filed May 3, 2005, entitled "Bar Clip With Flared Legs" and co-pending U.S. patent application Ser. No. 11/142,539 filed Jun. 1, 2005, entitled "Bar Clip Applicator," both of which are hereby incorporated by reference.

BACKGROUND OF THE INVENTION

The present invention relates generally to a system and method of attaching and aligning reinforcing bars in a framework for supporting a concrete matrix. More particularly, this invention pertains to an apparatus and method of attaching bar clips to reinforcing bars so as to join the bars in a framework. Even more particularly, this invention pertains to a clip applicator system for applying bar clips for joining pairs of reinforcing bars in a parallel orientation.

It has been long known in the art of reinforced concrete structures to provide fastening means for aligning and attaching reinforcing bars in a framework prior to encasing such bars in a concrete matrix. One well known fastening means used in forming a framework of reinforcing bars is to wrap adjacent bars with wire ties, or other similar binding materials. Another well known fastening means is to attach such reinforcing bars by welding instead of wrapping. Both of these fastening means provide for attaching bars arranged in either transverse or parallel orientations. However, both means are labor intensive and, thus, more expensive when compared to the use of more recently developed reinforcing bar clips.

Plastic clips have been developed to provide a means of rapidly attaching adjacent reinforcing bars that are arranged in transverse orientations. For example, Padrum, in U.S. Pat. No. 4,110,951, teaches a plastic U-shaped clip formed by two opposing flanges extending from a base. Each of the flanges is split to form opposing and aligned openings within each flange. The clip is positioned and aligned above two reinforcement bars that are in a transverse orientation to each other. Pressure is applied by the user to the base of the clip. This pressure causes the first reinforcing bar to be forced between the flanges and held in an upper position. Continued application of pressure upon the base causes the second reinforcing bar to be forced between the opposing split openings in the flanges and held in a lower position independent of the first bar. Padrum does not teach an apparatus or method of applying the clip to the reinforcing bars and it is expected that the clips are applied by hand operations with the user in close proximity to the reinforcing bars.

A second example of prior art plastic clips is shown in U.S. Pat. No. 5,626,436 to Dragone. The Dragone clip is a U-shaped assembly comprising two parallel longitudinal members connecting two opposed hook assemblies. Each hook assembly comprises two connecting members, each extending from one of the longitudinal members, and a fulcrum section. A hook is formed by two opposing fingers, each attached at an opposite end of the fulcrum section and extending from the fulcrum section in a direction away from the longitudinal members. A gap is formed between each pair of opposing fingers. To install the Dragone clip, a first reinforcing bar is forced between the two opposed hook assemblies and held in an upper position against the parallel longitudinal members. The parallel longitudinal members are squeezed together by the user, causing each pair of opposing fingers to spread apart. The user slips the spread fingers of the opposing hooks over a second reinforcing bar that is positioned transverse to the first bar. The user then releases the parallel longitudinal members. As the parallel longitudinal members separate, each pair of opposing fingers close around the second bar and hold it in a lower position. The Dragone clip is sized so as to hold the second bar against the first bar. Dragone does not teach an apparatus or method of applying the clip to the reinforcing bars and it is expected that the clips are also applied by hand operations with the user in close proximity to the reinforcing bars.

One shortcoming of these two current art plastic clips is the necessity of hand manipulation of a clip and a bar during the application of a clip to a bar by the user. The user must grip the clip with the fingers and thumb of one hand while forcing the prior art clip onto the reinforcement bar. This method of application does not provide even application of force across the clip and may result in the clip slipping from the user's hand or off the reinforcement bar. Also, this method may create friction and pressure on the user's fingers, thumb and palm, which, in turn may cause bruises, blisters or calluses to form on the user's fingers, thumb or palm. This disadvantage of the current art can contribute to prolonged construction times, higher labor costs and user fatigue or injury.

What is needed, then, is a bar clip applicator system that applies a reinforcement bar clip onto a reinforcing bar without the need of manipulating the clip onto the bar directly by hand. It would be advantageous if the bar clip applicator system also provided for application of a bar clip to a reinforcement bar with uniform pressure across the bar clip. It would also be advantageous if the bar clip applicator system provided for easily recognizable coding means for matching the size of the bar clip, the bar clip applicator and the reinforcement bars.

BRIEF SUMMARY OF THE INVENTION

The present invention is directed toward a hand applicator for bar clip including a palm plate having a receiver tip, the receiver tip having a selected tip width and a width marking. The selected receiver tip is adapted to receive color-coded molded plastic reinforcement bar clips made of two opposing clasp assemblies of a size corresponding to the receiver tip width marking. With the second clasp assembly of the bar clip removably affixed to the receiver tip, the assembly forms a bar clip applicator system adapted to allow the user to attach the first clasp assembly of the bar clip to a reinforcement bar without direct manipulation of the bar clip onto the bar.

In preferred embodiments, the hand applicator further includes a retaining plate having a guide channel adapted to receive an extended thumb or finger from the user's hand while gripping the palm plate. The retaining plate is attached or integrally affixed to the palm plate and disposed so as to define an angle of between about 110 degrees and about 150 degrees. The retaining plate is operable with the palm plate to provide for ease of gripping and controlling the hand applicator with one hand of the user.

In other preferred embodiments, the hand applicator includes a heel plate attached or integrally affixed to the palm plate and disposed so as to define a heel angle of between about 90 degrees and about 180 degrees. The heel plate is operable with the palm plate and the retaining plate to provide for ease of gripping and controlling the hand applicator with one hand of the user.

Advantageously, the bar clip applicator system is formed of selectable and replaceable components that provide the user the ability to rapidly determine, select and install: a bar clip of the required gauge to a hand applicator having a receiver tip of the corresponding gauge so as to allow the user to manually apply a bar clip to a reinforcement bar without direct manipulation of the bar clip onto the bar.

Accordingly it is an object of the present invention to provide a hand applicator having a receiver tip having a gauge corresponding to the selected reinforcement bar clip.

It is an additional object of the present invention to provide a hand applicator having a palm plate, retaining plate and heel plate that are adapted to provide for ease of gripping and controlling the hand applicator with one hand of the user.

It is an additional object of the present invention to provide a reinforcement bar clip that is removably attachable to a receiver tip of a hand applicator and that can be used to attach adjacent reinforcing bars arranged in a framework.

Finally, it is an object of the present invention to provide a means of guiding a reinforcement bar into a clasp during installation of the clip.

DETAILED DESCRIPTION OF THE INVENTION

Figure 5:
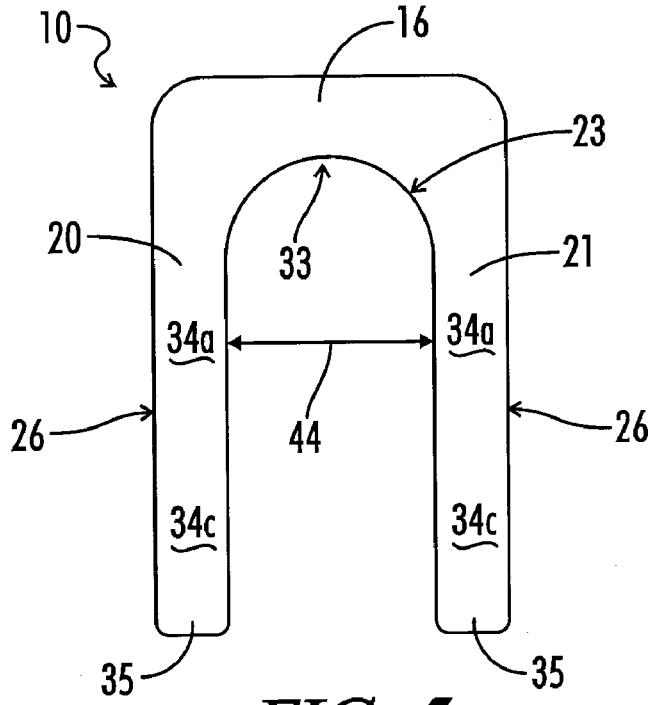
FIG. 5 is a side view of the bar clip of the present invention.
Figure 6:
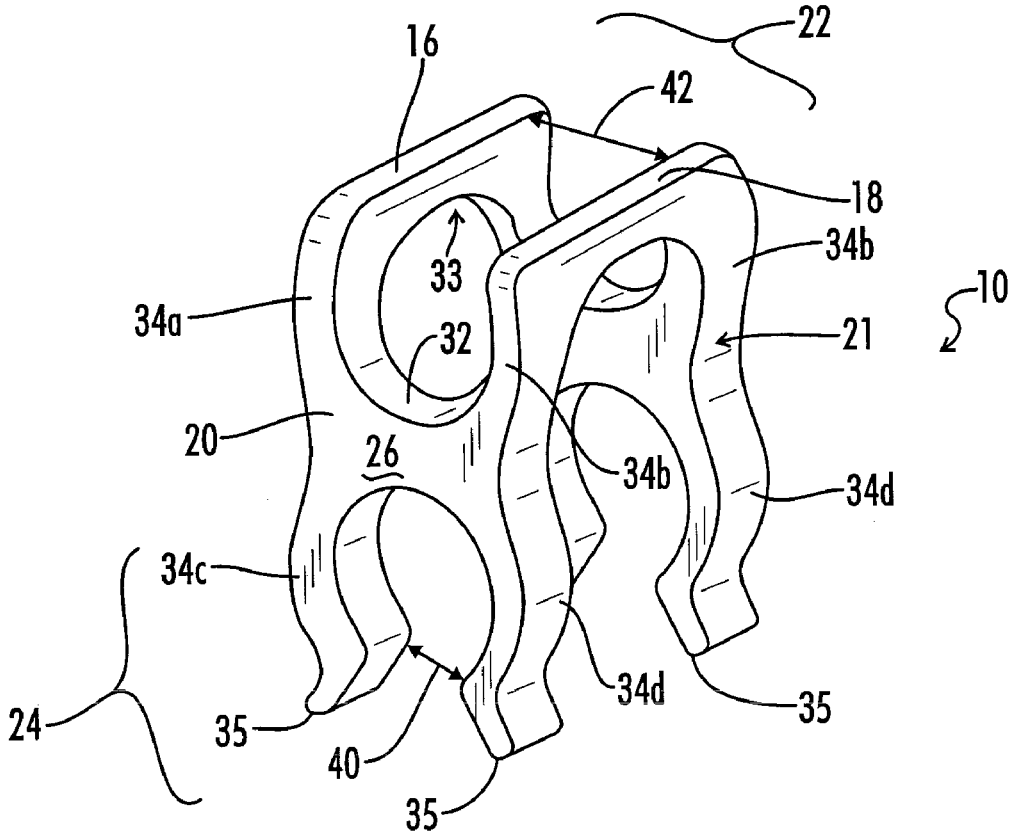
FIG. 6 is oblique view of the bar clip of FIG. 5.
Figure 7:
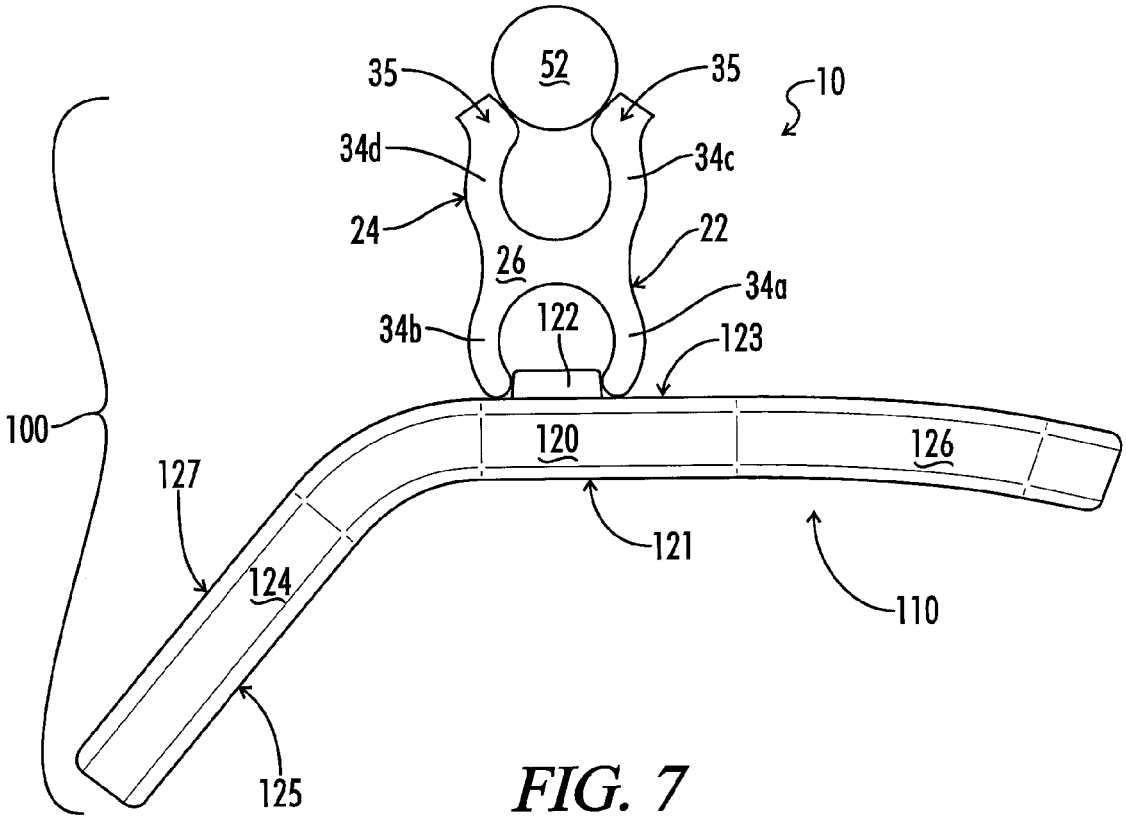
FIG. 7 is side view of the hand applicator system for the reinforcement bar clip applicator system of the present invention, including the bar clip of FIG. 5 rigidly affixed to the hand applicator of FIG. 1, positioned for installation of the first claps of the bar clip upon a reinforcement bar.

One preferred embodiment of the bar clip applicator system 100 of the present invention is shown in FIG. 7. The bar clip applicator system 100 includes a novel reinforcement bar clip 10 friction fitted upon the receiver tip 122 of a hand applicator 110. The novel reinforcement bar clip 10 includes a plurality of clasp assemblies. The embodiment shown in FIGS. 5-7 comprises a pair of opposing first and second clasp assemblies 20, 21. Each first and second clasp assembly 20, 21 is attached to parallel first and second longitudinal supports 16, 18 and extends downward from the longitudinal supports 16, 18. The opposing first and second clasp assemblies 20, 21, together with the first and second longitudinal supports 16, 18, form a U-shaped profile, as is shown in FIG. 5.

Referring again to FIGS. 5-7, the first and second clasp assemblies 20, 21 each comprise an upper clasp 22 for holding a first reinforcement bar and a lower clasp 24 for holding a second reinforcement bars in a parallel orientation to the first reinforcement bar. For each first and second clasp assembly 20, 21, opposing, convexly curved fingers 34 extend upward from either end of a transverse support 26 so as to form the upper clasp 22. One finger 34*a* is shown attached to the first longitudinal support 16 and the opposing finger 34*b* is shown attached to the second longitudinal support 18. Together with the transverse support 26, the opposing fingers 34*a*, 34*b* form an upper seat 32. An upper clasp gap 42 is disposed between the first and second longitudinal supports 16, 18 so as to provide a means of inserting the first reinforcement bar into the upper clasp 22. The upper clasp gap 42 is selected so as to be narrower than the diameter of the first reinforcement bar, while the upper seat 32 is adapted in size and shape to compressively engage the first reinforcement bar when such bar is placed within the upper clasp 22.

Referring again to FIGS. 5-7, for each first and second clasp assembly 20, 21, opposing, convexly curved fingers 34*c*, 34*d* extend downward from either end of the transverse support 26 so as to form the lower clasp 24. Together with the transverse support 26, the pair of opposing fingers 34*c*, 34*d* form a lower seat 30. A lower clasp gap 40 is disposed between the opposing fingers 34*c*, 34*d* so as to provide a means of inserting a reinforcement bar into the lower clasp 24. The lower clasp gap 40 is selected so as to be narrower than the diameter of the second reinforcement bar, while the lower seat 30 is adapted in size and shape to compressively engage the second reinforcement bar when such bar is placed within the lower clasp 24.

The reinforcement bar clip 10 of the bar clip applicator system 100 of the present invention is shown in FIG. 7 installed upon the hand applicator 110. In this configuration, the bar clip applicator system 100 is ready for installation of the reinforcement bar clip 10 upon a reinforcement bar 52.

In a particularly preferred embodiment, the reinforcement bar clip 10 is made of a resilient molded plastic having a color selected to indicate the appropriate gauge of the bar clip, the term 'gauge' is used herein to indicate the size of bar that the bar clip can attach and hold. For example, a bar clip 10 having a red color may have a gauge of 0.425 inches and a bar clip 10 having a white color may have a gauge of 0.525 inches. Other color coding schemes would be obvious to one skilled in the skilled in the art. Optionally, the gauge of the clip is cast, printed or otherwise numerically indicated on the surface of the clip 10. Preferably, the gauge of the clip is indicated by both color of the bar clip 10 and by a numerical indication embossed on the surface of the bar clip 10. Advantageously, color coding of reinforcement bar clips provides a simple method of allowing the user to rapidly identify and select the appropriate reinforcement bar clip 10 from a mixed selection of clips. Also, where the reinforcement bars of a single gauge are used to form a framework, use of color-coded reinforcement bar clips allows for easy identification of errors caused by inadvertent use of the wrong size of reinforcement bar clips in forming the framework.

Figure 1:
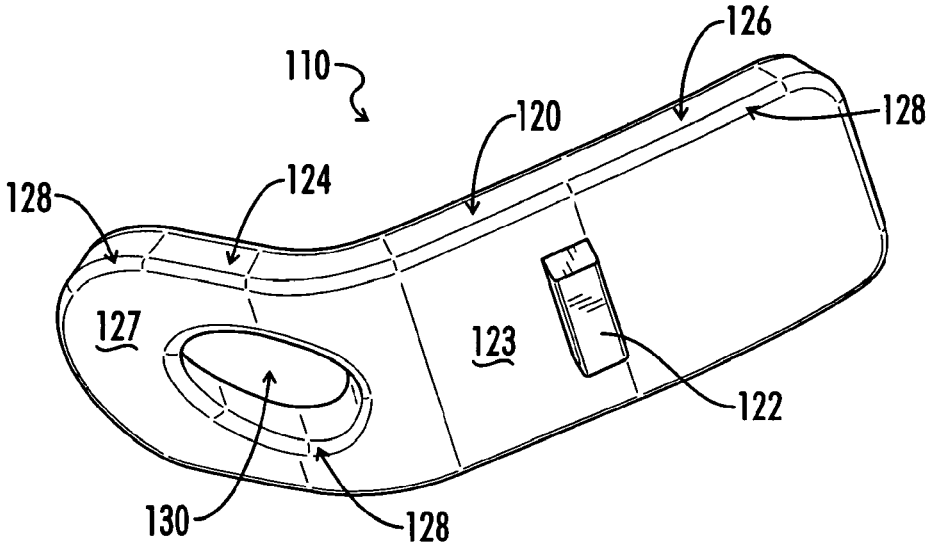
FIG. 1 is an oblique view of the hand applicator of the reinforcement bar clip applicator system of the present invention.

Referring now to FIG. 1, the hand applicator 110 of the present invention also includes a receiver tip 122 attached to an applicator block adapted to be gripped in the hand of a user. Referring to FIGS. 1-4, the applicator block of the preferred embodiment of the applicator includes a palm plate 120 shaped and sized to be gripped in the hand of a user. The palm plate 120 has a palm surface 121 and an opposing receiver surface 123. In the preferred embodiment shown, the palm surface 121 is flat and smooth so as to more readily allow for a transfer of force from the palm of the user's hand to the palm plate 120.

Figure 2:
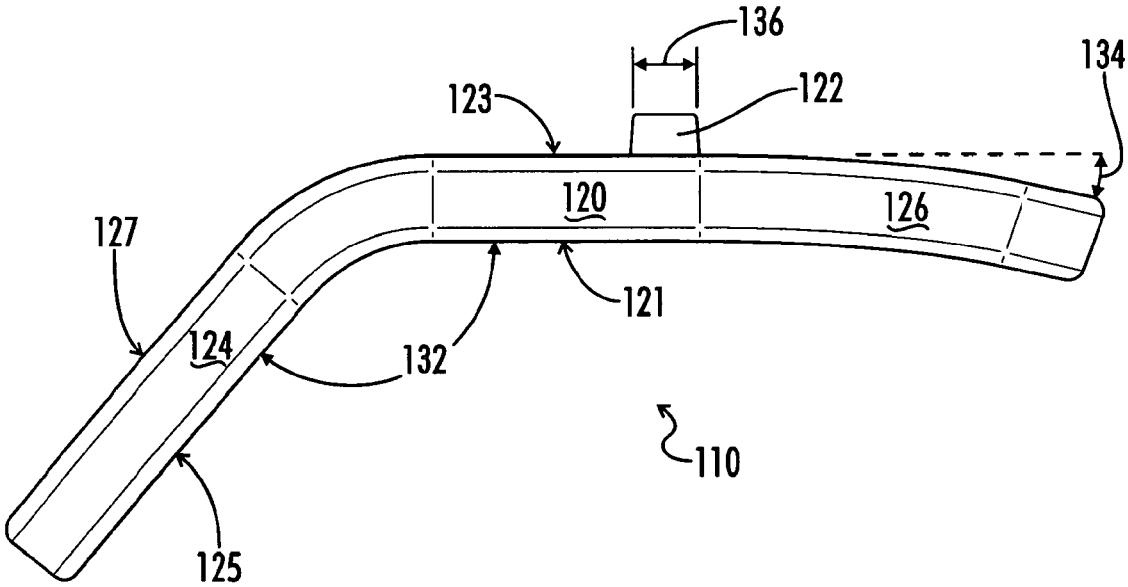
FIG. 2 is a cross-sectional view of the hand applicator of FIG. 1.
Figure 3:
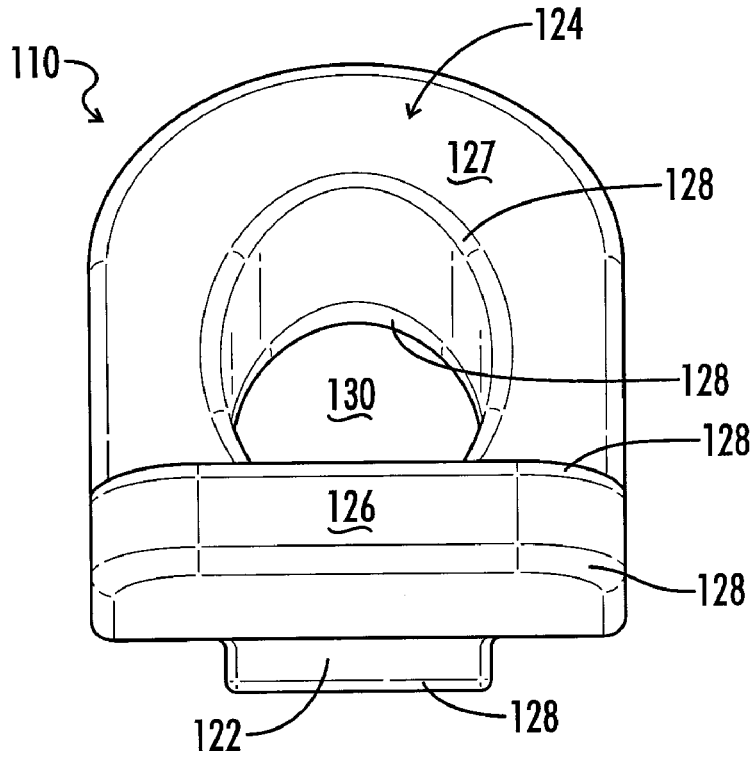
FIG. 3 is an end view of the hand applicator of FIG. 1.
Figure 4:
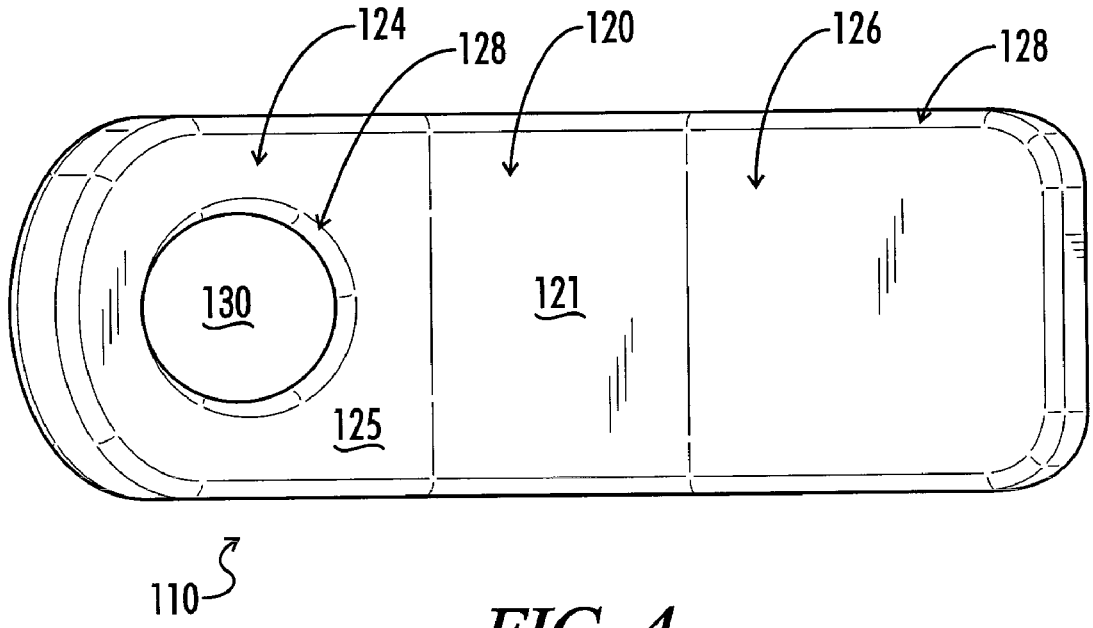
FIG. 4 is a plan view of the hand applicator of FIG. 1.

In the preferred embodiment, the receiver tip 122, which may also be referred to as receiver block 122, is formed by at least one rectangular block integral to or permanently affixed to the palm plate 120. As shown in FIGS. 1-4, a receiver block 122 extends from the receiver surface 123 of the palm plate 120. As shown in FIG. 7, the receiver block 122 is adapted to receive the upper clasp 22 of the novel reinforcement bar clip 10. Referring to FIG. 2 the receiver block 122 has a width 136 sized to receive a correspondingly selected reinforcement bar clip 10, as shown in FIGS. 5 and 6. In an alternate preferred embodiment not shown, a plurality of receiver blocks 122 extend from the receiver surface 123 of the palm plate 120, each of the plurality of receiver blocks 122 having a width 136 that differs from the width 136 of the each of the other receiver blocks 122 such that the hand applicator 110 of this embodiment is adapted to receive and hold bar clips 10 of various gauges.

In yet another alternate preferred embodiment not shown, the receiver block 122 of the preferred embodiment of the hand applicator 110 is designed to be removable and selectable, with the selected receiver block 122 having a width 136 corresponding to the gauge of reinforcement bar clip 10 required for the joining of the reinforcement bars. The width 136 is determined by the gauge size of the bar clip 10 to be installed and is selected such that the upper clasp 22 fingers 34*a* and 34*b* slide over the receiver block 122 and engage the sides of the block. Optionally, each receiver block 122 is labeled so as to indicate to a user the gauge or width 136 of the particular embodiment of the receiver block 122. For example, a selected receiver block 122 may have a label that indicates the gauge numeral "5" and, as such, corresponds to a selected bar clip 10 having a red color and a gauge of 0.425 inches. Other color-numerical gauge coding schemes would be obvious to one skilled in the skilled in the art. Optionally, the gauge of the receiver block 122 is cast, printed or otherwise numerically indicated on a surface of the receiver block 122. Advantageously, numerically coding the receiver block 122 provides a simple method of allowing the user to rapidly identify and select the appropriate receiver block 122 from a mixed selection of receiver blocks 122 based on the gauge of the color-coded reinforcement bar clip 10 selected.

Another aspect of this novel applicator system 100 is the retaining plate 124 of the hand applicator 110. In the preferred embodiment shown in FIGS. 1-4, the hand applicator 110 includes a retaining plate 124 attached or integrally affixed to the palm plate 120. The retaining plate 124 includes a guide channel 130 extending from a first surface 125 of the retaining plate 124 to a second surface 127 of the retaining plate 124, wherein the second surface 127 is disposed opposite the first surface 125 and the guide channel 130. A first angle 132 is defined by the intersection of the first surface 125 of the retaining plate and the palm surface 121 of the palm plate 120. The first angle 132 is selected such that the user may readily extend a thumb or finger through the guide channel 130 while gripping the palm plate 120 during operation of the applicator to install a reinforcement bar clip upon a reinforcement bar. Thus the channel 130 is adapted to generally receive an extended thumb or finger of the user's hand while gripping the palm plate 120. The first angle 132 is preferably between about 110 degrees and about 150 degrees and is more preferably about 130 degrees. The bore of the guide channel 130 may be straight or tapered as desired to readily receive a thumb or finger, either gloved or ungloved. In the preferred embodiment shown in FIGS. 1-4, guide channel 130 is straight bored with beveled edges 128. In this embodiment, a plurality of the edges 128 of the hand applicator 110 are beveled for ease of gripping by the user. The retaining plate 124 is operable with the palm plate 120 to provide for ease of gripping and controlling the hand applicator 110 with one hand of the user.

Another aspect of this novel applicator system 100 is the optional heel plate 126 of the hand applicator 110. In the preferred embodiment shown in FIGS. 1-4, the hand applicator 110 includes a heel plate 126 attached or integrally affixed to the palm plate 120 and distally disposed to the retaining plate 124. A heel angle 134 is defined by the intersection of the heel plate 126 and the palm surface 121 of the palm plate 120. The heel angle 134 is between about 90 degrees and about 180 degrees and is preferably between about 135 degrees and about 180 degrees. More preferably the heel angle 134 is about 170 degrees. The heel plate 126 is operable with the palm plate 120 and the retaining plate 124 to provide for ease of gripping and controlling the hand applicator 110 with one hand of the user.

Figure 8:
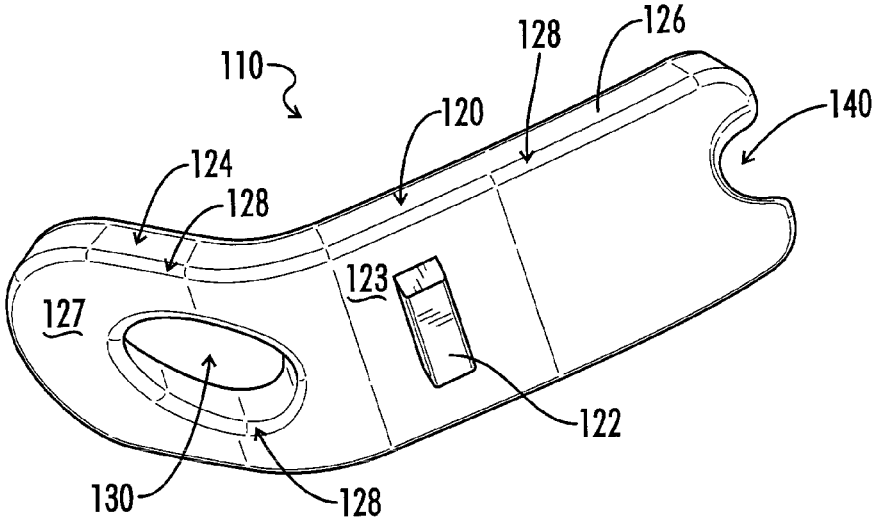
FIG. 8 is an oblique view of an alternate embodiment of the hand applicator of the reinforcement bar clip applicator system of the present invention.

In an alternate preferred embodiment shown in FIG. 8, a bar guide channel 140 is disposed in the heel plate 126 distal to the palm plate 120. The bar guide channel is sized and shaped to receive a reinforcement bar so as to provide for ease of manual capture of the reinforcement bar using the hand applicator 110. Once a reinforcement bar is received in the bar guide channel the operator may position the bar as desired. Rotation of the hand applicator 110 along the axis of the bar will align a bar clip installed on the receiver tip 122 with the bar for speed and ease of installation of the bar clip upon the bar.

A preferred method of installing the bar clip 10 upon one or more reinforcement bars is shown in FIG. 7. The gauge of the first reinforcement bar is determined and the appropriate gauge of bar clip 10 is selected. A hand applicator 110 is selected by the numerically indicated gauge of the applicator's receiver tip 122 appropriate for installation into the first clasp 22 of the selected bar clip 10. The bar clip 10 is removably installed upon the hand applicator 110 by sliding the receiver tip 122 into the upper clasp gap 42 so as to form a rigid assembly held together by a friction fit between the receiver tip 122 and the first and second longitudinal supports 16, 18.

One novel aspect of the present invention is the flared guide 35 attached to the lower ends of each opposing finger 34*c*, 34*d* of the lower clasp 24. As shown in FIG. 7, during installation of the lower clasp 24 of the clip 10 upon a reinforcement bar 52, each pair of flared guides 35 engage the bar 52 and guide it to the lower clasp gap 40 for insertion into the lower clasp 24 of each clasp assembly 20, 21. As the lower clasp 24 is pressed against the reinforcement bar 52, the flaring of guides 35 cause the opposing fingers 34*c*, 34*d* to spread open so as to enlarge the lower clasp gap 40 sufficiently for the insertion of the bar 52. After the bar 52 is inserted into the lower clasp 24, the opposing fingers 34*c*, 34*d* close so as to hold the bar in the lower seat 30. Once the reinforcing bar 52, is inserted into the lower clasp 24, the receiver tip 122 of the hand applicator 110 is removed from the upper clasp gap 42.

With the upper clasp gap 42 clear, a second reinforcement bar, is positioned above the upper clasp gap 42. In one embodiment of the present invention, the user must manually grasp the second reinforcement bar and position it above the upper clasp gap 42. In alternate embodiments of the present invention, the hand applicator 110 further included a means of capturing a second reinforcement bar such as the bar guide channel 140 is disposed in the heel plate 126 as described above. This invention also contemplates various additional means of capturing the second reinforcement bar, including a crook or hook attached to the hand applicator 110 and adapted to receive a reinforcement bar. In the method of this invention using such a capture means allows the user to manually position the second reinforcement bar above the second clasp gap without directly manipulating the second bar. The second reinforcement bar and the clip 10 are forced together so as to cause the opposing fingers 34*a*, 34*b* to spread open so as to enlarge the upper clasp gap 42 sufficiently for the insertion of the bar. After the bar is inserted into the upper clasp 22, the opposing fingers 34*a*, 34*b* close so as to hold the bar in the upper seat 32.

Thus, although there have been described particular embodiments of the present invention of a new and useful Hand Applicator For Reinforcement Bar Clips, it is not intended that such references be construed as limitations upon the scope of this invention except as set forth in the following claims.

What is claimed is:

1. In combination, a reinforcement bar clip and applicator comprising:

an applicator body adapted to be held by a user, the applicator body including:

a palm plate having a palm surface and a receiver surface, the receiver surface disposed opposite the palm surface;

a retaining plate having a guide channel extending from a first surface of the retaining plate to an opposing second surface of the retaining plate, the guide channel adapted to generally receive an extended thumb or finger; the retaining plate being connected with the palm plate such that the first surface intersects the palm surface so as to define a first angle less than 180 degrees, the first angle selected such that the user may readily extend a thumb or finger through the guide channel when gripping the palm plate during manual operation of the applicator to install a reinforcement bar clip upon a reinforcement bar; and a heel plate connected to the palm plate and distally disposed to the retaining plate such that the heel plate intersects the palm surface so as to define a heel angle, the heel angle selected such that the heel plate is operable with the palm plate and the retaining plate to provide for ease of gripping and controlling the hand applicator with one hand of the user, the heel plate further including a bar guide channel disposed in the heel plate distal to the palm plate; and, a receiver tip attached to the applicator body, wherein the receiver tip extends from the receiver surface, thereby extending in a direction away from the first angle; and a reinforcement bar clip engaging the receiver tip, the clip having opposing first and second clasps, each clasp comprising a plurality of pairs of opposing flexible fingers forming a first clasp gap and second clasp gap, between the respective pairs of opposing flexible fingers.

2. The apparatus of claim 1, wherein the first angle is between about 110 degrees and about 150 degrees.

3. The apparatus of claim 2, wherein the first angle is about 130 degrees.

4. The apparatus of claim 1, wherein the receiver tip comprises:

a receiver block having a width selected such that inserting the receiver block width-wise into the second clasp gap of the bar clip forms a rigid assembly held together by friction fit between the receiver block and at least two opposing flexible fingers of the second clasp.

5. The apparatus of claim 1, wherein the receiver tip is removably affixed to the retaining plate.

6. The apparatus of claim 4, the apparatus further comprising:

a width marking corresponding to the width of the receiver block.

7. The apparatus of claim 1, wherein the heel angle is between about 90 degrees and about 180 degrees.

8. The apparatus of claim 1, wherein the heel angle is about 170 degrees.

* * * * *